United States Patent [19]

Harrison

[11] Patent Number: 4,747,596

[45] Date of Patent: May 31, 1988

[54] SCORER'S TABLE

[75] Inventor: Grant Harrison, Salt Lake City, Utah

[73] Assignee: Specta-View, Inc., Del Ran, N.J.

[21] Appl. No.: 871,493

[22] Filed: Jun. 6, 1986

[51] Int. Cl.[4] ..... A63B 71/06

[52] U.S. Cl. ..... 273/1 ES; 108/23

[58] Field of Search ..... 273/1 E, 1 ES, 85 G, 273/237, 138 A, 85 CP; 108/23

[56] References Cited

U.S. PATENT DOCUMENTS

| | | | |
|---|---|---|---|
| 4,030,764 | 6/1977 | Mattos | 273/1 ES |
| 4,093,215 | 6/1978 | Ballard | 273/1 ES |
| 4,648,599 | 3/1987 | Wiczer | 273/1 ES |

FOREIGN PATENT DOCUMENTS

| | | | |
|---|---|---|---|
| 8101766 | 6/1981 | Int'l Pat. Institute | 273/1 ES |

OTHER PUBLICATIONS

"UNEX" brochure of American Sign & Indicator Corporation.

*Primary Examiner*—Maryann Lastova

*Attorney, Agent, or Firm*—Wood, Herron & Evans

[57] ABSTRACT

A scorer's table for sporting events including a table top supported by legs, and three panels mounted at the front of the table and extending downwardly to the floor. The center panel has a front surface with a message which is painted or otherwise permanently displayed, such as the logo of a sports team or the name of an arena. The two end panels, one on each side of the center panel, each have display screens operable to display virtually any type of graphic or word message. The display screens are independently controlled by an electronic controller which is programmable to produce a message on each of the display screens and then change such messages as desired during the course of the sports event.

4 Claims, 1 Drawing Sheet

SCORER'S TABLE

BACKGROUND OF THE INVENTION

This invention relates to scorer's tables for sporting events, and more particularly, to a scorer's table having electronically operated display panels capable of displaying a variety of different advertisements or messages during the course of a sporting event..

It has been recognized that on-site advertising is a cost-effective and proven way to communicate with customers. Indoor and outdoor scoreboards at athletic events have been in use for some time which are capable of providing a variety of graphic and word messages or advertisements to the fans at the event, such as reminders of upcoming games, and other advertisements. Many of the more modern scoreboards display messages in color to further enhance the effectiveness of the advertisement.

One area where display boards capable of displaying difference advertisements has not been used is at the scorer's table of indoor athletic events. In basketball games, for example, the scorer's table is located at court side in view of everyone watching the game, including television viewers. In addition, the fans' attention is often drawn to the scorer's table at indoor sporting events such as basketball games where the substitute players check into the game, where time-outs and fouls are recorded and where commentators and/or announcers are seated.

Prior art scorers' tables used at basketball games or for other indoor sports events often include a banner draped over the front of the table with the team name or a permanent message printed thereon, but none includes any display board or other means of changing the advertisement or message during the course of the sporting event. This wastes valuable advertising space at a potentially effective location for conveying information to the viewers.

SUMMARY OF THE INVENTION

It is therefore an objective of this invention to provide a scorer's table having display panels which are controllable to display different messages and advertisements during the course of a sporting event.

This objective is accomplished in a scorer's table having a table top supported by legs, and a center panel and two end panels mounted to the front side of the table top which extend downwardly to the floor. In the presently preferred embodiment, the center panel has has a front surface which displays a permanent advertisement or message such as the logo of the home sport's team or the name of the arena. The end panels, located on opposite sides of the center panel, are each formed with a display screen which communictes with a programmable electronic controller. The display screens are independently operated by the controller to display different messages or advertisements throughout the course of the sporting event.

The scorer's table of this invention employs commercially available illuminated display screens and electronic controllers for displaying essentially any type or word or graphic message. For example, in one presently preferred system the display screens of the end panels are formed with a grid of apertures which are selectively opened and closed in response to signals from the controller. Lamps mounted behind the end panels shine light through the open apertures to illuminate a desired graphic or word message.

Alternatively, the end panels may be formed with a pattern or grid of apertures, each of which align with the terminal end of an optic fiber. Bulb-matrix grid may also suffice. The controller is operable to either energize selected optic fibers to produce the desired message; or, to operate shutters which block the light from selected optic fibers, all of which are continuously energized.

The scorer's table herein thus provides an additional location for conveying advertisements and messages to the fans watching indoor sporting events. The messages on the display screens of each end panel can be varied as desired to communicate a substantial amount of advertising or other information to the fans during the course of a sporting event.

DESCRIPTION OF THE DRAWINGS

The structure, operation and advantages of a presently preferred embodiment of this invention will become further apparent upon consideration of the following description taken in conjunction with the accompanying drawings, wherein.

DETAILED DESCRIPTION OF THE INVENTION

Figure 1:
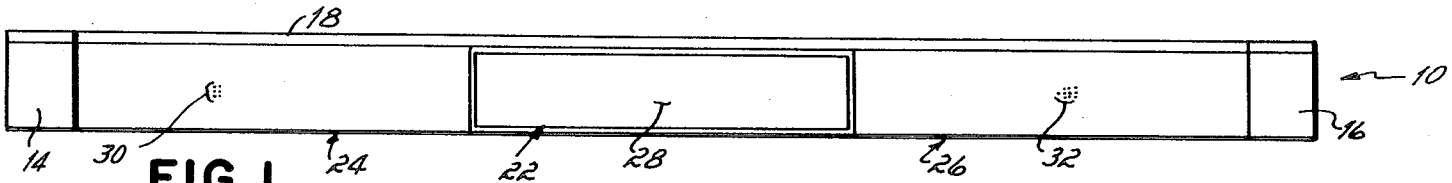
FIG. 1 is a front view of the scorer's table of this invention.
Figure 2:
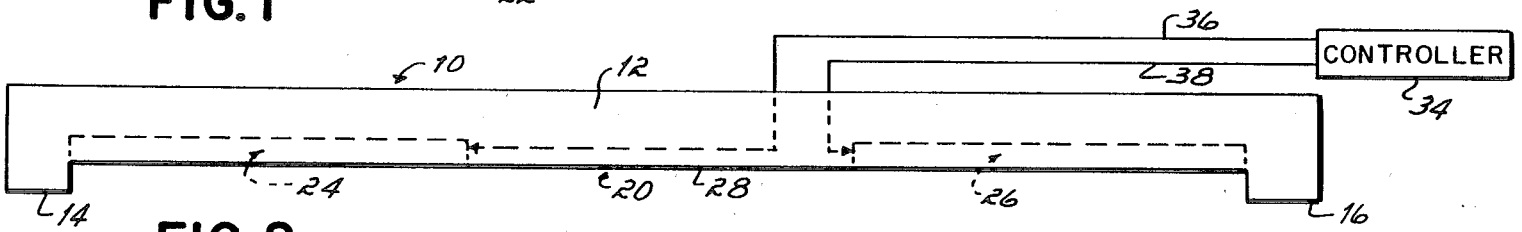
FIG. 2 is a top view of the scorer's table schematically showing the electronic display panels and controller.

Referring now to the drawings, the scorer's table 10 of this invention comprises a U-shaped table top 12 supported at opposite ends by legs 14, 16. An upright guard panel 18 is mounted to the table top 12 at the front 20 of the table 10. The table elements are made of wood, metal or other suitable materials.

Three panels are mounted to the table top 12 at the front 20 of the table including a center panel 22 located at the center of the table 10, and two end panels 24, 26 located on opposite sides of the center panel 22. The panels 22, 24, 26 each extend from the table top 12 to the floor.

In a presently preferred embodiment, the center panel 22 has a front face 28 on which artwork (not shown) is painted or otherwise permanently affixed. The artwork may take the form of the logo of an athletic team, the name of the arena in which the sporting events are held and the like.

Figure 3:
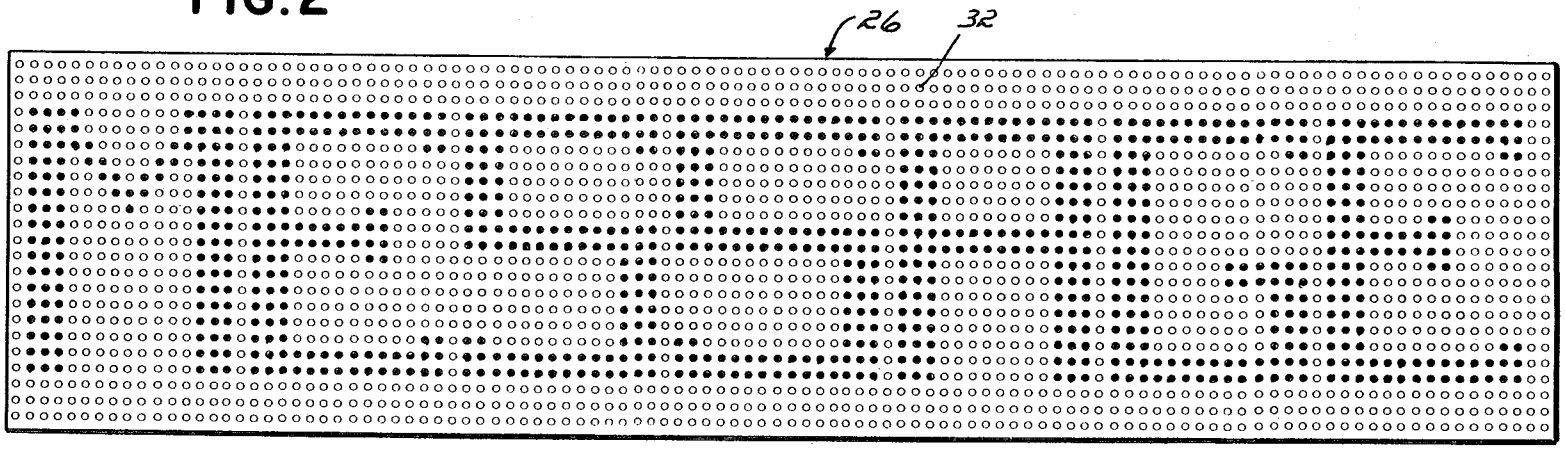
FIG. 3 is an enlarged front view of the display screen of one of the end panels.

The end panels 24, 26 are each provided with a display screen 30, 32, respectively, for displaying a "message" as illustrated in FIG. 3. The message appearing on each display screen 30, 32 is independently controlled by a programmable, electronic controller 34. The controller 34 is operable to send signals through lines 36, 38 connected to display screens 30, 32, respectively, to cause a different message to be displayed on each screen 36, 38 and change such messages periodically during the course of a sporting event.

Display screens and a controller of the type employed in scorer's table 10 are commercially available. One presently preferred system which can be employed in this invention is sold by American Sign & Indicator Corporation of Spokane, Wash. under the trade name UNEX. In this system, the display screen is comprised of an array of thousands of small apertures, each of which is controlled by an electronic controller to pass or block light from a common light source within the unit. Messages, in word or graphic form, are formed on the screen by selectively opening the desired apertures. The position of each aperture is individually controlled in response to signals received from the controller.

Other commercially available systems are also suitable for use as the display screens 30, 32 for end panels 24, 26. For example, the display screen 30, 32 may be formed with a grid of apertures each aligned with the terminal end of an optic fiber. Such systems employ a controller which functions in one of two ways. In one mode of operation, the controller continuously energizes the optic fibers and selectively operates shutters which either open or block the apertures so that only the open apertures pass light to form the desired graphics or words. Alternatively, the controller operates to selectively energize the optic fibers needed to form a particular word or design and de-energize the remaining optic fibers.

In any suitable commercially available form, the display screens 30, 32 are operated independently of one another by the controller 34 to produce essentially any desired graphic or word message which can be displayed periodically throughout the course of a sporting event.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A scorer's table for sporting events having a front side and a rear side, comprising:

a table top adapted to be supported in a horizontal position by legs;

a center panel having a top, bottom and opposed sides, said top of said center panel being mounted at the center of said table top and said center panel extending vertically downwardly therefrom on said front side of said table, said center panel displaying a permanent message;

a pair of end panels each having a top, bottom and opposed sides, said top of each said end panels being mounted to said table top and said end panels extending vertically downwardly therefrom on said front side of said table on either of said sides of said center panel, each of said end panels having a display screen for displaying a message, the message appearing on each of said display screens being controlled by signals from an electronic controller communicating with said display screens.

2. The scorer's table of claim 1 in which said center panel is formed with a front surface having a message permanently affixed thereon.

3. The scorer's table of claim 1 in which said display screen of each of said end panels is formed with an array of apertures, said controller being operable to illuminate selected apertures to display a desired message on said display screen.

4. A scorer's table for sporting events having a front side and a rear side, comprising:

a table top adapted to be supported in a horizontal position by legs;

a center panel having a top, bottom and opposed sides, said top of said center panel being mounted at the center of said table top and said center panel extending vertically downwardly therefrom on said front side of said table, said center panel displaying a permanent message;

a pair of end panels each having a top, bottom and opposed sides, said top of each said end panels being mounted to said table top and said end panels extending vertically downwardly therefrom on said front side of said table on either of said sides of said center panel, each of said end panels having a display screen for displaying a message;

programmable controller means for sending signals to each said display screens of said end panels to produce different messages thereon and change said messages during the course of a sporting event.

* * * * *